US008106855B2

(12) United States Patent
Choi et al.

(10) Patent No.: US 8,106,855 B2
(45) Date of Patent: Jan. 31, 2012

(54) ENERGY RECOVERY CIRCUIT AND DRIVING APPARATUS OF DISPLAY PANEL

(75) Inventors: Hak-Ki Choi, Suwon-si (KR); Nam-Sung Jung, Suwon-si (KR); Jun-Weon Song, Suwon-si (KR); Joo-Yul Lee, Suwon-si (KR); Myoung-Kyu Lee, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 977 days.

(21) Appl. No.: 11/711,082

(22) Filed: Feb. 27, 2007

(65) Prior Publication Data

US 2007/0200800 A1 Aug. 30, 2007

(30) Foreign Application Priority Data

Feb. 28, 2006 (KR) ..... 10-2006-0019291
Apr. 19, 2006 (KR) ..... 10-2006-0035362
Oct. 30, 2006 (KR) ..... 10-2006-0105815

(51) Int. Cl.
*G09G 3/28* (2006.01)

(52) U.S. Cl. ..... 345/68

(58) Field of Classification Search ..... 345/60–68, 345/204

See application file for complete search history.

(56) References Cited

U.S. PATENT DOCUMENTS 4,866,349 A 9/1989 Weber et al.
6,111,556 A * 8/2000 Moon ..... 345/60
6,744,218 B2 6/2004 Kang et al.
6,888,518 B2 * 5/2005 Roh et al. ..... 345/68
2002/0054001 A1 5/2002 Awamoto
2003/0030632 A1 2/2003 Choi
2003/0197696 A1 * 10/2003 Onozawa et al. ..... 345/212
2003/0214462 A1 11/2003 Roh et al.
2005/0099364 A1 * 5/2005 Jung et al. ..... 345/60

(Continued)

FOREIGN PATENT DOCUMENTS

EP 1 333 419 A2 8/2003

(Continued)

OTHER PUBLICATIONS

Office Action issued on Oct. 16, 2006 by the Korean Intellectual Property Office for Korean Patent Application No. 2005-97520.

(Continued)

*Primary Examiner* — Richard Hjerpe
*Assistant Examiner* — Carolyn R Edwards
(74) *Attorney, Agent, or Firm* — Christie, Parker & Hale, LLP

(57) ABSTRACT

A driving apparatus of a plasma display panel (PDP) operates stably and reliably. The driving apparatus to drive the PDP includes a pulse application unit which applies a pulse to the PDP; and an energy recovery unit which comprises an inductor which generates LC resonance with a panel capacitor element of the PDP, an energy recovery determiner which determines the accumulation of energy during the LC resonance or emission of the accumulated energy to the PDP, and an energy storage unit which stores the accumulated energy, wherein the energy recovery determiner comprises a first falling switching device which determines the accumulation of the energy; and a second falling switching device which is connected between the first falling switching device and the energy storage unit, in order for the second falling switching device to form a current path toward the energy storage unit.

44 Claims, 11 Drawing Sheets

U.S. PATENT DOCUMENTS

| | | | |
|---|---|---|---|
| 2005/0258776 | A1 | 11/2005 | Moon |
| 2006/0145954 | A1 | 7/2006 | Kubota et al. |

FOREIGN PATENT DOCUMENTS

| | | | |
|---|---|---|---|
| EP | 1 359 562 | A2 | 11/2003 |
| JP | 2000-330515 | | 11/2000 |
| JP | 2002-132208 | | 5/2002 |
| JP | 2005-266460 | | 9/2005 |
| KR | 2001-97045 | | 11/2001 |
| KR | 2003-0046059 | | 6/2003 |
| KR | 2003-47533 | | 6/2003 |
| KR | 10-2005-0100940 | | 10/2005 |
| KR | 10-2005-0110372 | | 11/2005 |
| KR | 10-2005-0115126 | | 12/2005 |
| KR | 10-2006-0069266 | | 6/2006 |

OTHER PUBLICATIONS

U.S. Appl. No. 11/529,360, filed Sep. 2006, Kwang-Ho Jin, Samsung SDI Co., Ltd.

Search Report issued in European Patent Application No. 07103131.4 on Jul. 6, 2007.

"IR2113 High and Low Side Driver Product Summary", Data Sheet No. PD-6.030C, International Rectifier, Control Integrated Circuit Designer's Manual, pp. B-61-B-74.

"IR2113 High and Low Side Driver Product Summary", Data Sheet No. PD-6.030C, International Rectifier, Control Integrated Circuit Designer's Manual, pp. B-61-B-74, dated Mar. 23, 2005.

Office Action issued in corresponding Korean Patent Application No. 2006-0105815 dated Oct. 26, 2007.

SIPO Certificate of Patent dated Apr. 13, 2011, for corresponding Chinese Patent application 200710003199.3. noting listed references in this IDS, as well as references of which English counterparts were previously submitted in an IDS dated Jul. 11, 2007.

Patent Abstracts of Japan, and English machine translation of Japanese Publication 2005-266460, 63 pages.

KIPO Notice of Allowance dated Aug. 17, 2007, for Korean priority Patent application 10-2006-0035362, 4 pages.

Notice of Allowance dated Jan. 9, 2008, for Korean priority Patent application 10-2006-0105815, 4 pages.

* cited by examiner

ENERGY RECOVERY CIRCUIT AND DRIVING APPARATUS OF DISPLAY PANEL

CROSS-REFERENCE TO RELATED APPLICATIONS

This application claims the benefit of Korean Patent Application Nos. 2006-19291, filed on Feb. 28, 2006, 2006-35362, filed on Apr. 19, 2006, and 2006-105815, filed on Oct. 30, 2006 in the Korean Intellectual Property Office, the disclosures of which are incorporated herein by reference.

BACKGROUND OF THE INVENTION

1. Field of the Invention

Aspects of the present invention relate to a driving apparatus of a plasma display panel (PDP), and more particularly, to an energy recovery circuit included in a driving apparatus, which can achieve operational stability and reliability of a switching device while recovering energy.

2. Description of the Related Art

A plasma display panel (PDP) is a flat display device having a wide screen, which displays a desired image by applying a discharge voltage between two substrates each having a plurality of electrodes, wherein discharge gas is trapped between the two substrates and used to generate ultraviolet rays which excite a phosphor pattern.

A driving apparatus of a PDP includes a plurality of power sources, a plurality of switching devices, and a plurality of drive integrated circuits (ICs) which control switching operations of the switching devices, in order to apply drive signals to each of a plurality of electrodes disposed in the PDP. The driving apparatus of the PDP outputs the drive signals by using the switching operations of the plurality of switching devices. The driving apparatus of the PDP can be classified into a pulse application unit and an energy recovery unit. The pulse application unit applies a pulse to the PDP, and the energy recovery unit recovers and restores energy (wall charge) from a discharge cell inside the PDP wherein the discharge is performed by the pulse applied by the pulse application unit, in order to reduce unnecessary consumption of power.

The energy recovery unit includes a switching device, an inductive device for resonance, a capacitive device storing recovered energy (wall charge), etc. Here, the switching device is driven by a switching control signal. The switching control signal is outputted in pulse form from an integrated device, generally called a drive IC. The switching control signal in pulse form passes through a capacitor to remove a DC element thereof, and because of this, the waveform of the switching control signal is distorted. Due to the distorted switching control signal, the switching device generates excessive heat, and may burn out. These problems specifically occur in the switching device when it is used while the energy recovery unit recovers energy.

SUMMARY OF THE INVENTION

Aspects of present invention include a driving apparatus of a plasma display panel (PDP) which operates stably and reliably.

According to an aspect of the present invention, a driving apparatus to drive a PDP (plasma display panel), includes a pulse application unit which applies a pulse to the PDP; and an energy recovery unit which includes an inductor which generates LC resonance with a panel capacitor element of the PDP, an energy recovery determiner which determines accumulation of energy during the LC resonance or emission of the accumulated energy to the PDP, and an energy storage unit which stores the accumulated energy, wherein the energy recovery determiner includes a first falling switching device which determines the accumulation of the energy; and a second falling switching device which is connected between the first falling switching device and the energy storage unit, in order for the second falling switching device to form a current path toward the energy storage unit.

The second falling switching device may be connected between the first falling switching device and the energy storage unit, in order for an internal diode of the second falling switching device to form a current path toward the energy storage unit.

The first falling switching device and the second falling switching device may be FETs (field effect transistors), and source terminals thereof are commonly connected.

A common switching control signal may be inputted to gate terminals of the first falling switching device and the second falling switching device.

A bootstrap capacitor may be connected to the common source terminal, and the bootstrap capacitor may be charged along a path of the internal diode of the first falling switching device, the inductor, and a ground terminal of the pulse application unit.

The energy recovery determiner further includes: a rising switching device which determines the emission of the accumulated energy stored in the energy storage unit to the PDP; and a diode which is a one-way conduction device that transmits the accumulated energy to the PDP.

The pulse application unit includes: a first voltage source which supplies a first voltage; a first voltage switching device which switches the first voltage and transmits the first voltage to the PDP; a second voltage source which supplies a second voltage; and a second voltage switching device which switches the second voltage and transmits the second voltage to the PDP.

The second voltage may be a ground voltage.

The energy storage unit may include an energy storage capacitor which is connected between the ground terminal and the energy recovery determiner.

The pulse may be a sustain pulse which is used to generate a sustain discharge in a discharge cell selected from among a plurality of discharge cells included in the PDP.

The pulse may be an address pulse which selects a discharge cell that is to be turned on from among the discharge cells included in the PDP.

According to another aspect of the present invention, a driving apparatus to drive a PDP (plasma display panel) includes: a pulse application unit which applies a pulse to the PDP; and an energy recovery unit which includes an inductor which generates an LC resonance with a panel capacitor element of the PDP, an energy recovery determiner which determines accumulation of energy during the LC resonance or emission of the accumulated energy to the PDP, and an energy storage unit which stores the accumulated energy, wherein the energy recovery determiner includes a falling switching device which determines the accumulation of the energy, and a falling diode which is a one-way conduction device that is connected between the falling switching device and the energy storage unit in order to from a current path in a direction from the falling switching device to the energy storage unit.

The driving apparatus may further include a switching device driving unit which is electrically connected to a driving terminal of the falling switching device so as to apply a high level voltage or a low level voltage in order to drive the falling switching device, wherein a bootstrap capacitor is connected between a power supply terminal of the high level voltage and a power supply terminal of the low level voltage.

The falling switching device may be an FET, and a source terminal of the FET may be connected to the falling diode.

The driving apparatus may further include a switching device driving unit which is electrically connected to a gate terminal of the falling switching device so as to apply a high level voltage or a low level voltage in order to drive the falling switching device, wherein a bootstrap capacitor is connected to the source terminal.

The bootstrap capacitor may be charged along a path of the internal diode of the first falling switching device, the inductor, and a ground terminal of the pulse application unit.

The switching device driving unit may further include an amplifier which outputs a high level voltage or a low level voltage in response to a signal that controls operations of the falling switching device.

One end of the bootstrap capacitor may be electrically connected to a high level power input terminal of the amplifier, and the other end of the bootstrap capacitor may be electrically connected to a low level power input terminal of the amplifier and the source terminal of the falling switching device.

The switching device driving unit may further include a bootstrap diode which is electrically connected between a driving voltage source and the one end of the bootstrap capacitor.

The switching device driving unit may further include: a first resistor which is electrically connected between an output terminal of the amplifier and the gate terminal of the falling switching device; and a second resistor which is electrically connected between the output terminal of the amplifier and the source terminal of the falling switching device.

The low level voltage may be a ground voltage.

According to another aspect of the present invention, there is provided an energy recovery circuit in a display panel having a panel capacitor between at least two electrode lines from among a plurality of electrode lines, wherein the energy recovery circuit recovers power from the panel capacitor or charges power in the panel capacitor, the energy recovery circuit including: an energy storage unit which is charged by recovering power from the panel capacitor; an energy recovery determiner which controls charging or recovery of power from the energy storage unit to the panel capacitor; and an inductor in which one end is connected to an end of the energy recovery determiner, and another end is connected to the panel capacitor, wherein the energy recovery determiner includes: a rising switching device and a falling switching device which are connected in parallel between the energy storage unit and the inductor; a rising diode which is connected between the rising switching device and the inductor in order for a current to flow from the rising switching device to the inductor; and a falling diode which is connected between the falling switching device and the energy storage unit in order for a current to flow from the falling switching device to the energy storage unit.

The rising switching device and the falling switching device may each include a switching device, and a rising switching device driving unit and a falling switching device driving unit to drive each switching device.

One terminal of the rising switching device driving unit may be connected to a first voltage source, and another terminal of the rising switching device driving unit may be connected between the rising switching device and the rising diode.

The rising switching device may include a first terminal connected to the energy storage unit, a second terminal connected to the rising diode, and a third terminal, wherein current flow from the first terminal to the second terminal is controlled by a signal applied to the third terminal.

The rising switching device may be an FET, wherein the first terminal is a drain terminal, the second terminal is a source terminal, and the third terminal is a gate terminal.

The rising switching device driving unit may include a driving device which controls application of a signal from the first voltage source to the third terminal of the first control switch, by an input signal.

The driving device may include a drive signal input terminal wherein the input signal is applied, a power applying terminal which is connected to the first voltage source, and an output terminal which is connected to the third terminal of the first control switch.

The power applying terminal may be connected between the rising switching device and the rising diode through a first capacitor.

According to aspects of the present invention, by common source connecting falling switching devices of an energy recovery unit and not using a DC coupling capacitor, a driving voltage is charged stably, the falling switching devices operates stably, and generation of heat and burning out of the falling switching devices are reduced, and thus reliability is achieved.

According to an aspect of the present invention, an energy recovery circuit of a display, includes an inductor connected to the display, an energy storage unit to recover energy from the display, and an energy recovery determiner connected between the inductor and the energy storage unit, wherein the energy recovery determiner has a first unidirectional path to supply energy from the energy storage unit to the display, and a second unidirectional path to recover energy from the display, and the first and second unidirectional paths have parallel elements in parallel arrangement, wherein the energy recovery determiner includes a rising switching device and a rising diode, and a first falling switching device and a second falling switching device, and wherein the rising diode is arranged after the rising switching device in the first unidirectional path, and the second falling switching device is arranged after the first falling switching device in the second unidirectional path.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the aspects, taken in conjunction with the accompanying drawings of which.

DETAILED DESCRIPTION OF THE EMBODIMENTS

Figure 1:
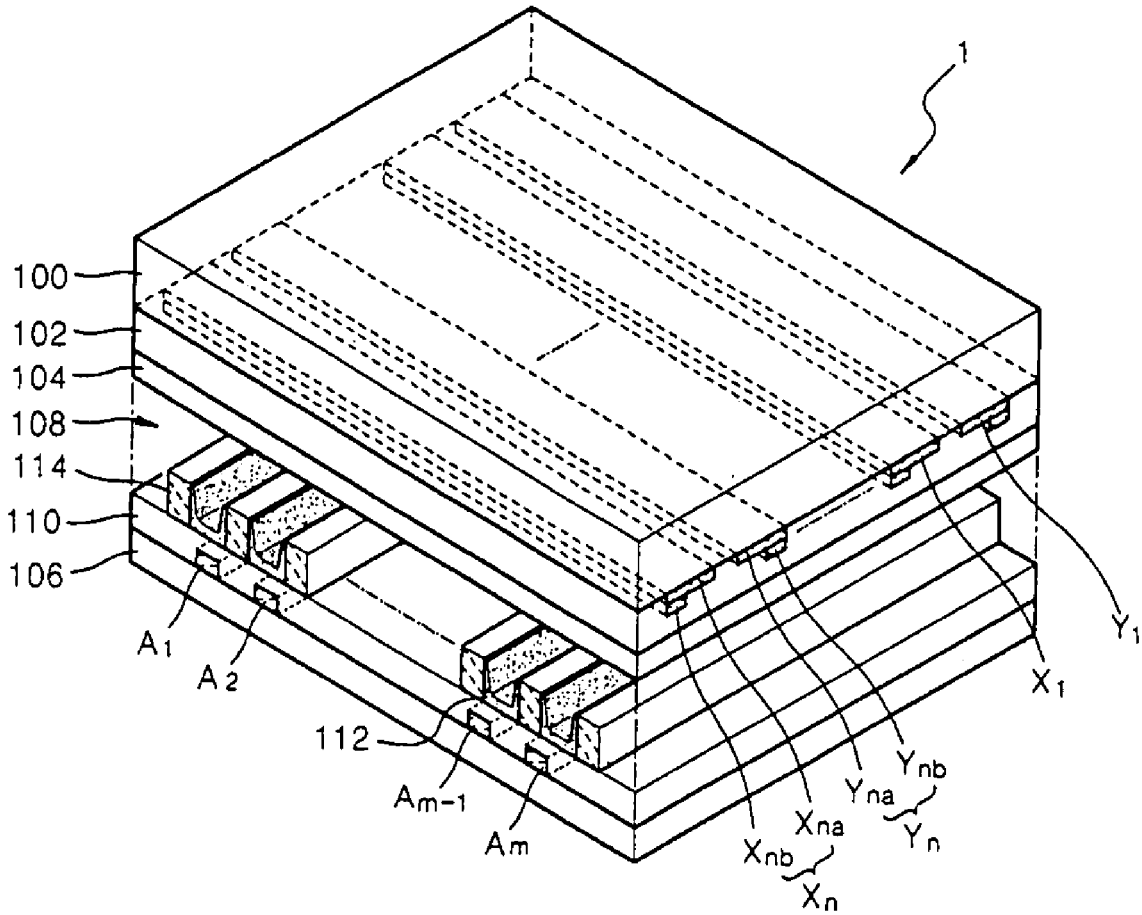
FIG. 1 is a diagram illustrating a plasma display panel (PDP) driven by a driving apparatus according to an aspect of the present invention.

Reference will now be made in detail to the aspects of the present invention, examples of which are illustrated in the accompanying drawings, wherein like reference numerals refer to the like elements throughout. The aspects are described below in order to explain the present invention by referring to the figures.

Hereinafter, the present invention will be described more fully with reference to the accompanying drawings, in which aspects of the invention are shown.

Figure 2:
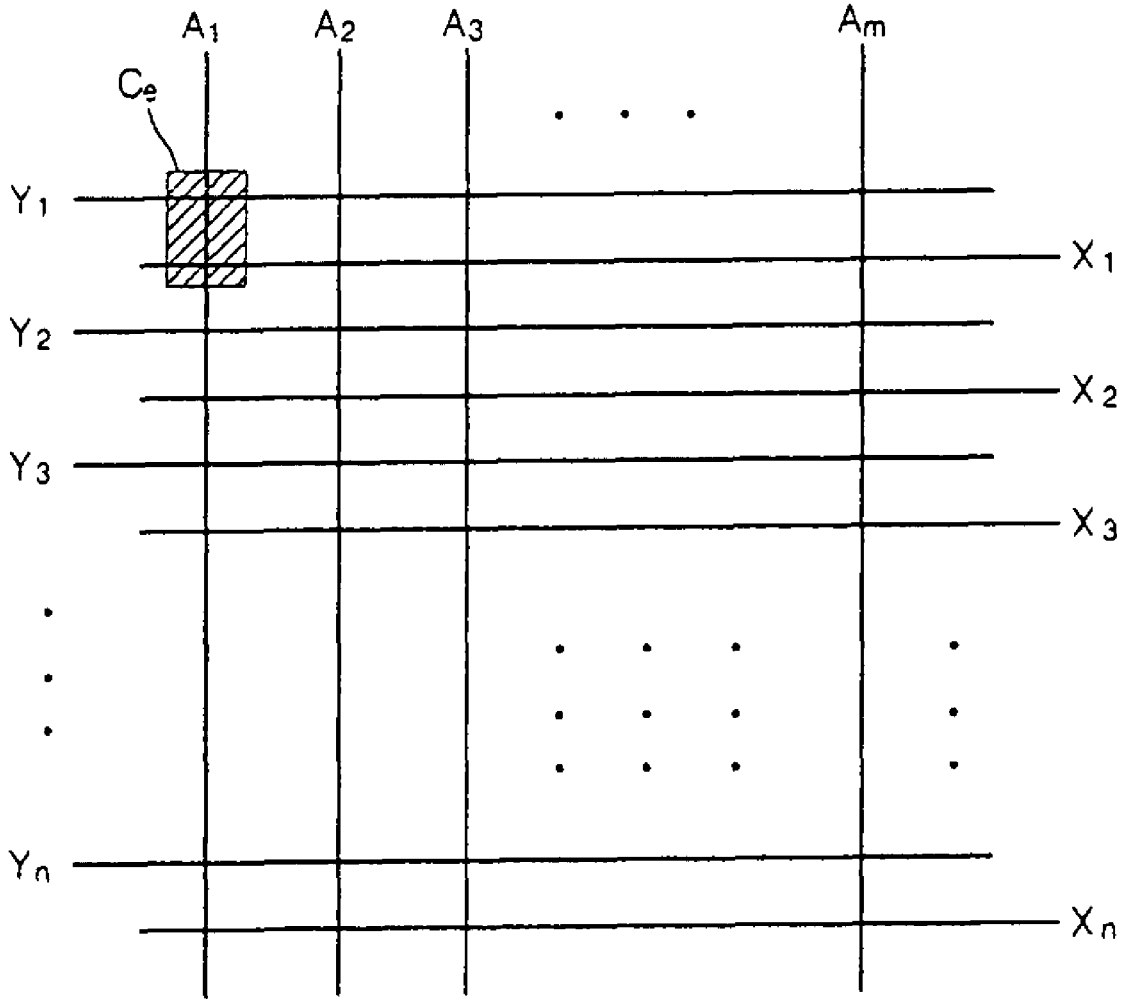
FIG. 2 is a diagram illustrating an arrangement of electrodes in the PDP of FIG. 1.

FIG. 1 is a diagram illustrating a plasma display panel (PDP) 1 driven by a driving apparatus according to an aspect of the present invention. FIG. 2 is a diagram illustrating an arrangement of electrodes in the PDP 1 of FIG. 1.

Referring to FIGS. 1 and 2, address electrodes A1 through Am, first and second dielectric layers 102 and 110, scan electrodes Y1 through Yn, sustain electrodes X1 through Xn, phosphor layers 112, barrier ribs 114, and a magnesium monoxide (MgO) protective layer 104 are formed between a first substrate 100 and a second substrate 106 of the PDP 1.

The address electrodes A1 through Am are formed in a uniform (or periodic) pattern on a side of the second substrate 106 facing towards the first substrate 100. The second dielectric layer 110 is coated on the address electrodes A1 through Am. The barrier ribs 114 are formed on the second dielectric layer 110, in parallel to the address electrodes A1 through Am. The barrier ribs 114 define a discharge area of each discharge cell, and prevent optical interference between the discharge cells. The phosphor layers 112 are coated on the second dielectric layer 110 corresponding to the address electrodes A1 through Am between the barrier ribs 114. Accordingly, phosphor layers emitting red light (R), green light (G), and blue light (B), are sequentially disposed. In various aspects, the phosphor layers are also coated on portions of the barrier ribs 114.

The sustain electrodes X1 through Xn and the scan electrodes Y1 through Yn are formed in a uniform (or periodic) pattern on a side of the first substrate 100 facing toward the second substrate 106, and extend at right angles to the address electrodes A1 through Am. Each crossing points thereof sets up (or defines) a corresponding discharge cell. Each of the sustain electrodes X1 through Xn and each of the scan electrodes Y1 through Yn can be formed by combining transparent electrodes Xna and Yna formed of a transparent conductive material, such as indium tin oxide (ITO), etc., and metal electrodes Xnb and Ynb having high conductivity, respectively. The first dielectric layer 102 is coated on the entire surface of the first substrate 100 to cover the sustain electrodes X1 through Xn and the scan electrodes Y1 through Yn. The protective layer 104, to protect the PDP 1 from strong electric fields, is a layer such as an MgO layer and coated on the entire surface of the first dielectric layer 102. Gas to form plasma is sealed in a discharge space 108. In various aspects, the gas is one or more inert or noble gas, such as neon and/or argon.

Meanwhile, a PDP driven using the method according to aspects of the present invention is not limited to the PDP 1 illustrated in FIG. 1. That is, the PDP may not only have a three-electrode structure as shown in FIG. 1, but may also have a two-electrode structure. On other aspects, more than three electrodes are within the scope of the invention. Other PDPs having various structures can be used, as long as they can be driven by the method according to aspects of the present invention.

The scan electrodes Y1 through Yn are respectively disposed parallel to the sustain electrodes X1 through Xn, the address electrodes A1 through Am are disposed to cross the scan electrodes Y1 and Yn and the sustain electrodes X1 through Xn, and the crossing areas thereof define discharge cells Ce.

Figure 3:
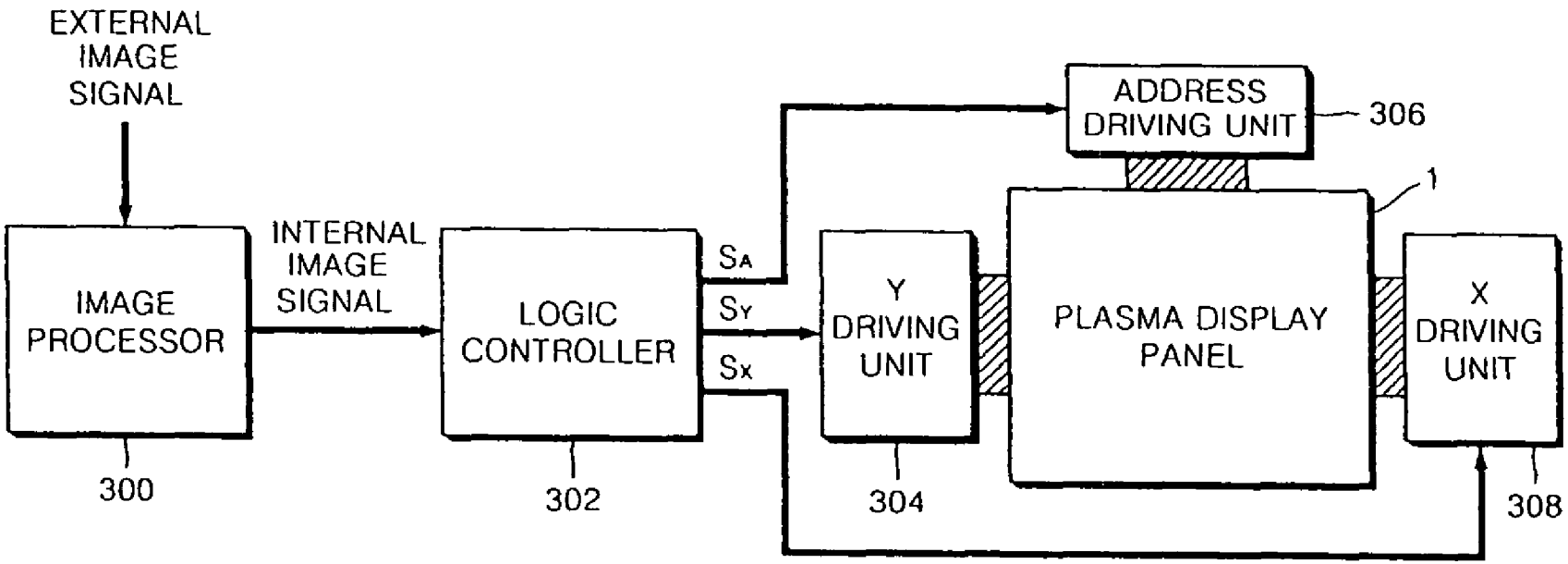
FIG. 3 is a block diagram illustrating a driving apparatus to drive the PDP of FIG. 1.

FIG. 3 is a block diagram illustrating a driving apparatus to drive the PDP 1 of FIG. 1.

Referring to FIG. 3, the driving apparatus of the PDP 1 includes an image processor 300, a logic controller 302, a Y driving unit 304, an address driving unit 306, an X driving unit 308, and a PDP 1. The image processor 300 converts an external image signal in order to generate an internal image signal. The logic controller 302 receives the internal image signal in order to output each of an address drive control signal $S_A$, a Y drive control signal $S_Y$, and an X drive control signal $S_X$. The Y driving unit 304, the address driving unit 306, and the X driving unit 308 each receives the respective drive control signals in order to output drive signals to each of the scan electrodes Y1 through Yn, the address electrodes A1 through Am, and the sustain electrodes X1 through Xn, respectively.

Figure 4:
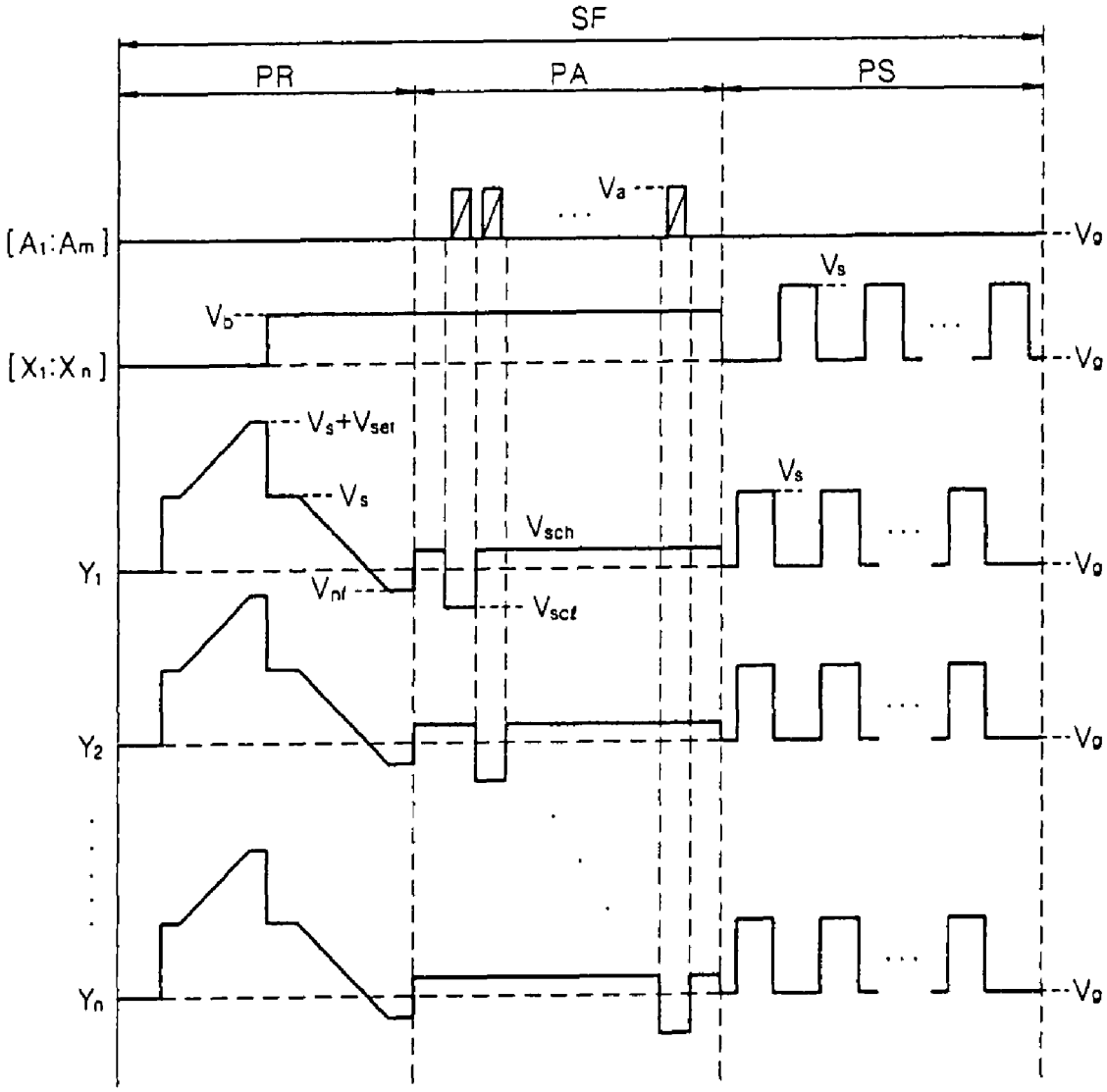
FIG. 4 is a schematic timing diagram illustrating drive signals outputted from each driving unit illustrated in FIG. 3.

FIG. 4 is a schematic timing diagram illustrating drive signals outputted from each driving unit illustrated in FIG. 3.

Referring to FIG. 4, a unit frame, which is a display cycle, to drive the PDP 1 of FIG. 3 can be classified into a plurality of subfields SFs, of which one is shown. Also, each subfield SF is classified into a reset period PR, an address period PA, and a sustain period PS.

First, during the reset period PR, reset pulses that include a rising ramp pulse (or portion) and a falling ramp pulse (or portion) are applied to the scan electrodes Y1 through Yn, and a second voltage Vb is applied to the sustain electrodes X1 through Xn from when the decreasing pulse (or the falling ramp pulse) is applied to the scan electrodes Y1 through Yn in order to perform a reset discharge. The entire discharge cells are initiated (or reset) by the reset discharge. For the scan electrodes Y1 through Yn, the rising ramp pulse increases from the level of a first voltage Vs to the level of a third voltage Vset in order to reach the highest voltage level Vset+Vs, and the falling ramp pulse decreases from the level of the first voltage Vs to the level of a fourth voltage Vnf.

During the address period PA, scan pulses are applied sequentially to the scan electrodes Y1 through Yn, and address pulses are applied to the address electrodes A1 through Am according to the scan pulses in order to perform an address discharge. Discharge cells in which a sustain discharge that is to be generated during the sustain period PS are selected by the address discharge. The scan pulses are initially at a fifth voltage Vsch, and gradually reach a sixth voltage Vscl, that is lower than the level of the fifth voltage Vsch. The address pulses are at a seventh voltage Va having a synchronized positive polarity, when the sixth voltage Vscl of the scan pulses is applied.

During the sustain period PS, sustain pulses are applied alternatively to the sustain electrodes X1 through Xn and the scan electrodes Y1 through Yn in order to perform the sustain discharge. The brightness of the unit field formed of the plurality of subfields depends on the sustain discharge performed based on a weighted value of a gray scale allocated to each subfield. The sustain pulses alternate between the first voltage Vs and a ground voltage Vg. Although some of the pulses are shown as square waves, various other types of wave forms for the pulses are within the scope of the present invention.

Accordingly, the drive signals illustrated in FIG. 4 are outputted from each driving unit illustrated in FIG. 3, but the drive signals are not limited to only the drive signals shown in FIG. 4.

Figure 5:
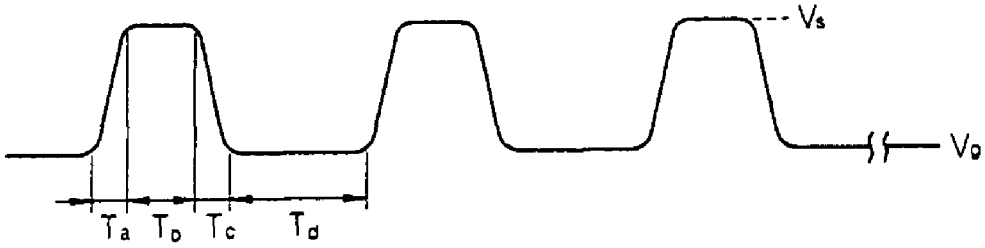
FIG. 5 is a waveform diagram illustrating sustain pulses from among the drive signals illustrated in FIG. 4.

FIG. 5 is a waveform diagram illustrating the sustain pulses from among the drive signals illustrated in FIG. 4.

Referring to FIG. 5, the sustain pulses are outputted from the X driving unit or the Y driving unit illustrated in FIG. 3. Also, the waveform illustrated in FIG. 5 is also generated by operations of a pulse application unit 80 illustrated in FIG. 8 and an energy recovery unit 82 illustrated in FIG. 8 which will be described later. The sustain pulses include a first period Ta that increases from the level of a ground voltage Vg to the level of a sustain voltage Vs, a second period Tb that maintains the sustain voltage Vs, a third period Tc that decreases from the level of the sustain voltage Vs to the level of the ground voltage Vg, and a fourth period (or voltage) Td that maintains the ground voltage Vg. The first period Ta and the third period Tc are periods during which the energy recovery unit 82 illustrated in FIG. 8 operates, and the second period Tb and the fourth period Td are periods during which the pulse application unit 80 illustrated in FIG. 8 operates. In various aspects, the slope of the first and third periods Ta and Tc may be steeper or gradual then as shown.

Figure 6:
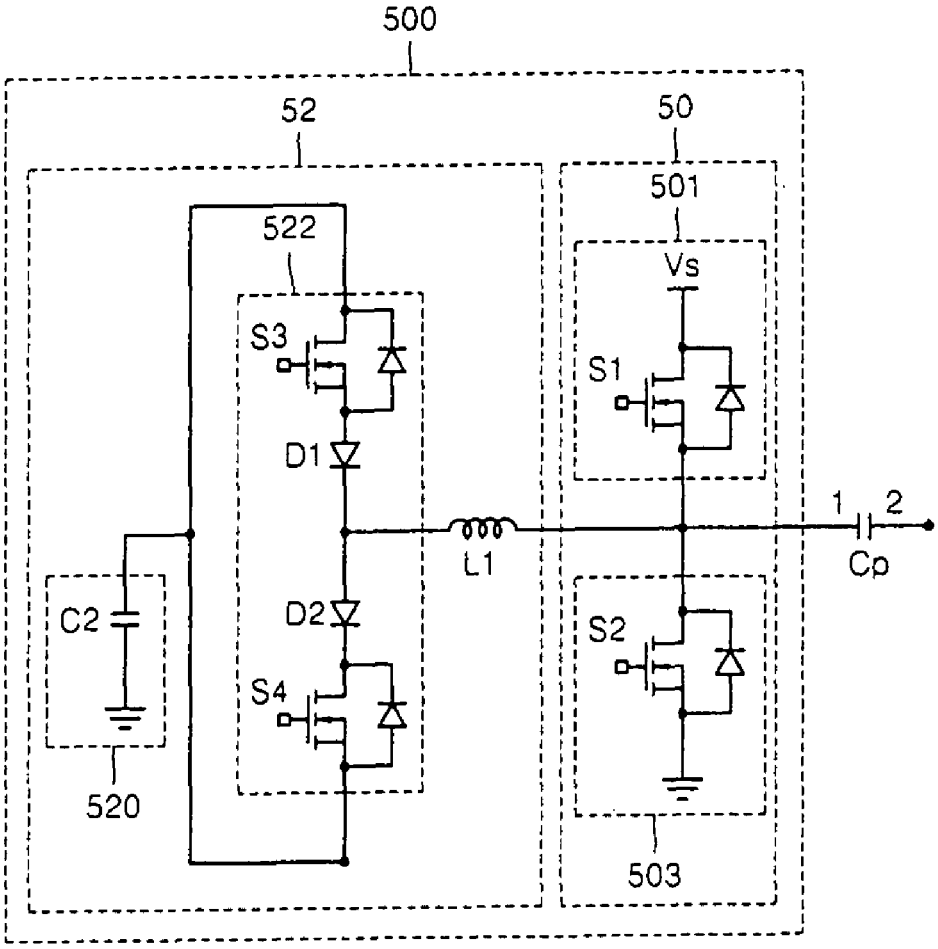
FIG. 6 is a circuit diagram illustrating a driving apparatus of a PDP, according to an aspect of the present invention.
Figure 7:
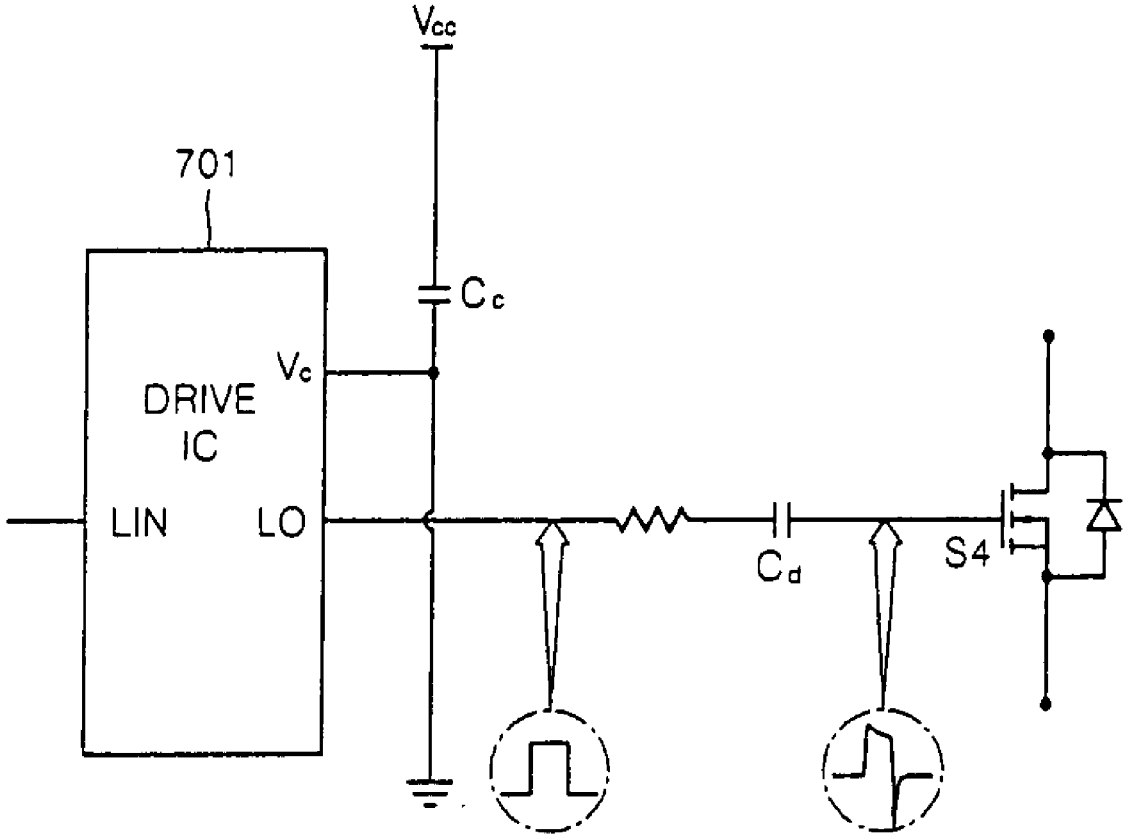
FIG. 7 is a diagram illustrating a drive integrated circuit (IC) which drives a fourth switching device illustrated in FIG. 6.

FIG. 6 is a circuit diagram illustrating a driving apparatus 500 of a PDP, which is compared with an aspect of the present invention. FIG. 7 is a diagram illustrating a drive integrated circuit (IC) 701, which drives a fourth switching device illustrated in FIG. 6.

Referring to FIG. 6, the driving apparatus 500 includes a pulse application unit 50 and an energy recovery unit 52. The pulse application unit 50 applies pulses to the PDP, that is, to any one of the electrodes illustrated in FIGS. 1 and 2. In the circuit diagram of FIG. 6, the PDP is shown as a panel capacitor Cp. Accordingly, the pulses are applied to one end of the panel capacitor Cp (a first terminal of the panel capacitor Cp, first electrodes from among the plurality of electrodes). Also, another pulse signal is applied to another end of the panel capacitor Cp (a second terminal of the panel capacitor Cp, or second electrodes from among the plurality of electrodes).

The pulse application unit 50 includes a first voltage applying unit 501 and a second voltage applying unit 503. The first voltage applying unit 501 includes a first voltage source and a first switching device S1 which switches a first voltage Vs supplied from the first voltage source in order to transmit the first voltage to the panel capacitor Cp (the first terminal). The second voltage applying unit 503 includes a second voltage source and a second switching device S2 which switches a second voltage Vg from the second voltage source and transmits the second voltage Vg to the panel capacitor Cp (the first terminal).

The energy recovery unit 52 includes an inductor L1, an energy recovery determiner 522, and an energy storage unit 520. The inductor L1 generates an LC resonance with a capacitance element of the panel capacitor Cp. The energy recovery determiner 522 determines accumulation of charges (energy) in the panel capacitor Cp by recovering the charges to the energy storage unit 520 or determines emission (or discharge) of the charges (energy) stored in the energy storage unit 520 to the panel capacitor Cp. Accordingly, the energy recovery determiner 522 includes a third switching device S3, a fourth switching device S4, an increasing diode D1, which is a one-way conduction device, and a decreasing diode D2. The recovered charges (energy) are stored in the energy storage unit 520. The energy storage unit 520 is embodied as (or include) a capacitor C2.

Looking at the sustain pulses generation process by referring to FIG. 5, the third switching device S3 is turned on during the first period Ta, the first switching device S1 is turned on during the second period Tb, the fourth switching device S4 is turned on during the third period Tc, and the second switching device S2 is turned on during the fourth period Td.

Further, each switching device operates by receiving a switching control signal from the drive IC 701 illustrated in FIG. 7. In detail, after a driving voltage from a driving voltage source supplying a voltage Vcc is charged in a driving voltage capacitor Cc, the switching control signal is outputted from an output terminal of the drive IC 701 by a predetermined signal applied to an input terminal LIN of the drive IC 701. The switching control signal outputted from the drive IC 701 is outputted in a pulse form having a pulse voltage approximately between 5V and 15V. Generally, a DC component is to be removed using a DC coupling capacitor Cd before the switching control signal is inputted to the switching devices. However, the DC coupling capacitor Cd distorts the waveform of the switching control signal. Such a problem specifically occurs in the fourth switching device S4 inside the energy recovery unit 52. That is, the fourth switching device S4 emits heat and may burn out due to the distorted waveform of the switching control signal.

Figure 8:
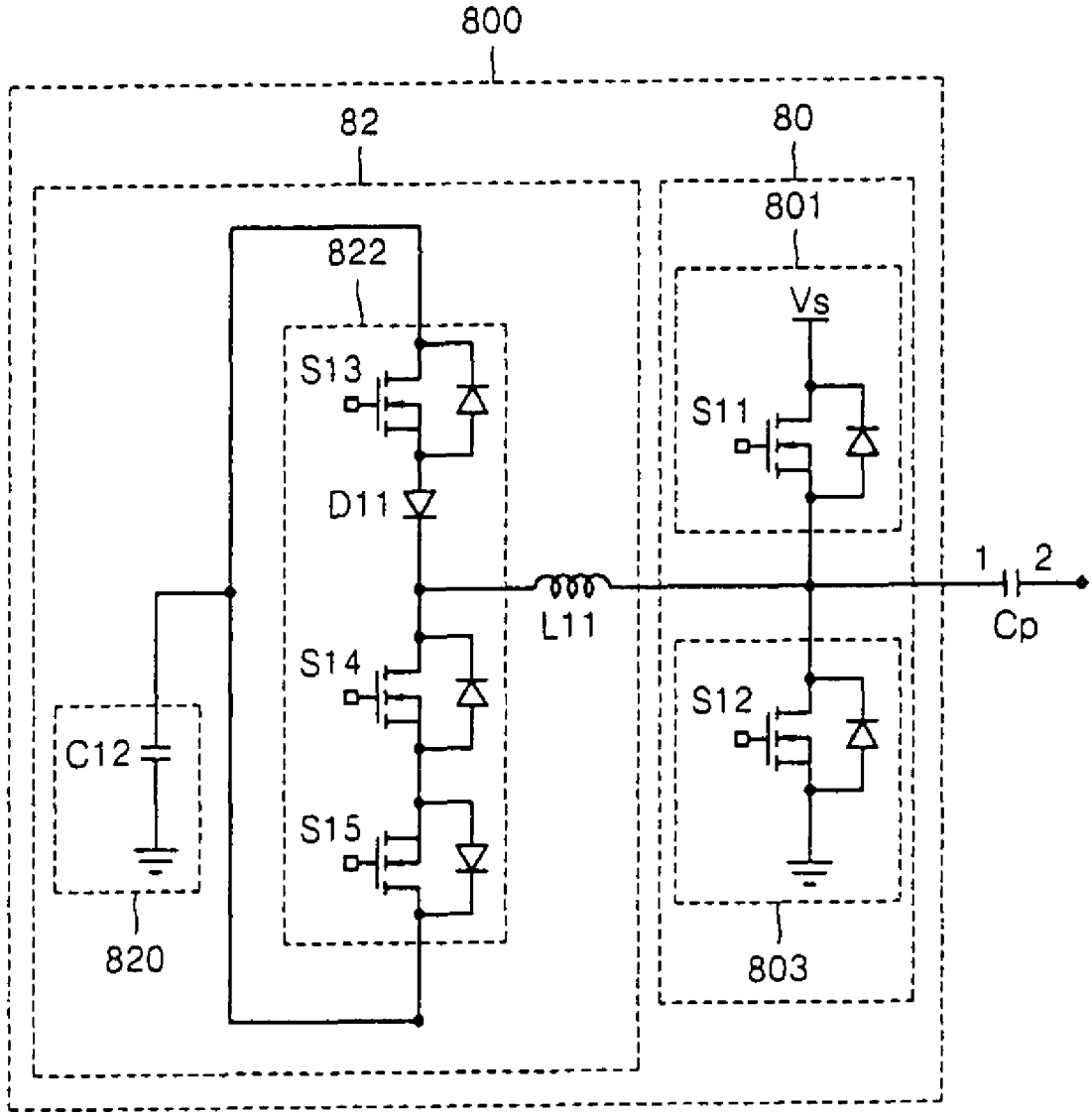
FIG. 8 is a circuit diagram illustrating a driving apparatus of a PDP according to an aspect of the present invention.
Figure 9:
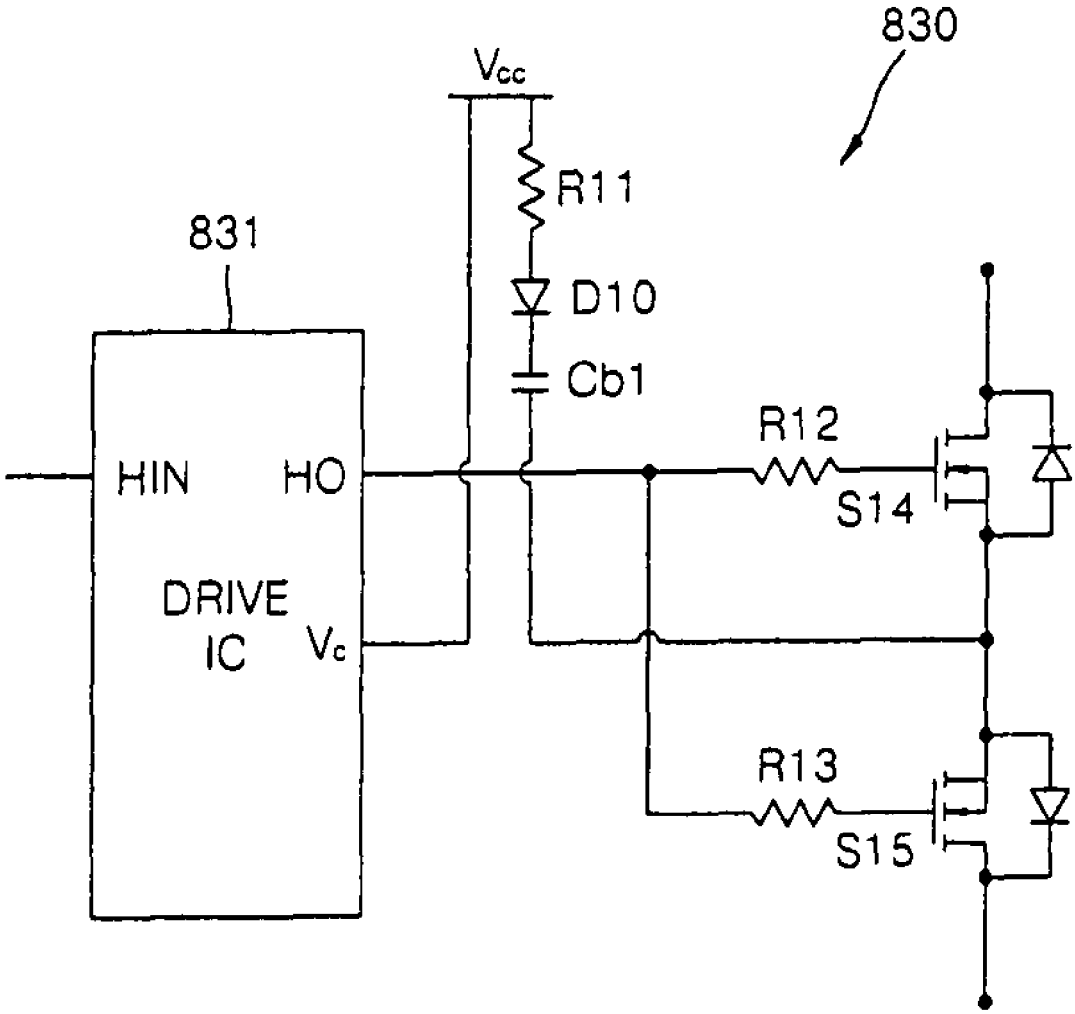
FIG. 9 is a diagram illustrating a drive IC which drives first and second falling switching devices illustrated in FIG. 8.

FIG. 8 is a circuit diagram illustrating a driving apparatus 800 of a PDP according to an aspect of the present invention. FIG. 9 is a diagram illustrating a drive IC 831 which drives first and second falling switching devices S14 and S15 illustrated in FIG. 8.

Referring to FIG. 8, the driving apparatus 800 includes a pulse application unit 80 and an energy recovery unit 82. Hereinafter, the PDP will be considered to be electrically equivalent to a panel capacitor Cp.

The pulse application unit 80 applies pulses in (or to) the panel capacitor Cp, and includes a first voltage applying unit 801 and a second voltage applying unit 803. The first voltage applying unit 801 includes a first voltage source, and a first voltage switching device S11 which switches a first voltage Vs supplied from the first voltage source and transmits the first voltage Vs to one end of the panel capacitor Cp (a first terminal). The second voltage applying unit 803 includes a second voltage source and a second voltage switching device S12 which switches a second voltage Vg from the second voltage source and transmits the second voltage Vg to one end of the panel capacitor (the first terminal). Here, the second voltage Vg may be a ground voltage.

Meanwhile, the pulses may be sustain pulses applied alternatively to scan electrodes Y1 through Yn and sustain electrodes X1 through Xn as illustrated in FIG. 2, during the sustain period PS. In this case, the first voltage Vs is a sustain voltage Vs. When the first voltage Vs is the sustain voltage Vs, one end of the panel capacitor Cp (the first terminal) may be a scan electrode, and the other end of the panel capacitor Cp (the second terminal) may be a sustain electrode. That is, the driving apparatus 800 according to this aspect of the present invention may be the Y driving unit 304 illustrated in FIG. 3.

Of course, when one end of the panel capacitor Cp (the first terminal) is the sustain electrode, the driving apparatus 800 may be the X driving unit 308 illustrated in FIG. 3. Also, the pulses may be the address pulses applied to the address electrodes A1 through Am during the address period PA illustrated in FIG. 2. Accordingly, one or more of the electrodes may be connected to the driving apparatus 800.

The energy recovery unit 82 includes an inductor L11, an energy recovery determiner 822, and an energy storage unit 820. The energy recovery unit 82 recovers and accumulates charges (energy) in the panel capacitor Cp or emits the accumulated (or stored) charges (energy) to the panel capacitor Cp. The inductor L11 generates an LC resonance with a capacitance element of the panel capacitor Cp in order to transmit energy while the pulses increase and decrease.

The energy recovery determiner 822 includes a first falling switching device S14, a second falling switching device S15, a rising switching device S13, and a diode D11, which is a one-way conduction device. The first falling switching device S14 and the second falling switching device S15 are disposed on a path in which charges (energy) are transmitted from the panel capacitor Cp to the energy storage unit 820. The rising switching device S13 and the diode D11 are disposed on a path in which charges (energy) are transmitted from the energy storage unit 820 to the panel capacitor Cp.

The energy storage unit 820 can be embodied as (or include) an energy storage capacitor C12, which is disposed between the energy recovery determiner 822 and a ground terminal.

Hereinafter, operations of the driving apparatus 800 according to this aspect of the present invention will be described with reference to the waveform of the sustain pulses illustrated in FIG. 5. During the first period Ta, the rising switching device S13 is turned on, and thus, charges (energy) stored in the energy storage unit 820 are transmitted to the panel capacitor Cp along a path formed by the rising switching device S13, the diode D11, and the inductor L11. At this time, an LC resonance is generated by the inductor L11 and capacitive element of the panel capacitor Cp.

During the second period Tb, the first voltage switching device S11 is turned on, and thus, the first voltage Vs is transmitted from the first voltage source to the panel capacitor Cp. During the third period Tc, the first falling switching device S14 and the second falling switching device S15 are turned on, and thus, charges (energy) of the panel capacitor Cp are transmitted to the energy storage unit 820 through the inductor L11, the first falling switching device S14, and the second falling switching device S15. During the fourth period Td, the second voltage switching device S12 is turned on, and thus, the second voltage Vg is transmitted (or applied) to the panel capacitor Cp.

The first and second falling switching devices S14 and S15 can be embodied as (or include) a field effect transistor (FET), and in this case, each source terminal thereof is commonly connected. That is, the source terminals are common source connected.

Also, a common switching control signal is inputted to each gate terminal of the first and second falling switching device S14 and S15. The second falling switching device S15 functions as a one-way conduction device, such as the falling diode D2 illustrated in FIG. 6.

That is, during the first period Ta, the first and second falling switching devices S14 and S15 are turned off, and thus, the charges (energy) from the energy storage unit 820 cannot be transmitted therethrough. This is also because internal diodes of the respective first and second falling switching devices S14 and S15 face in opposite directions to each other.

Hereinafter, operations of the first and second falling switching devices S14 and S15 will be described in detail with reference to FIG. 9. The first and second falling switching devices S14 and S15 are electrically connected to the drive IC 831. In order for the first and second falling switching devices S14 and S15 to operate, a bootstrap capacitor Cb1 connected to the common source terminal is first charged. When the second voltage switching device S12 is turned on, a path from the bootstrap capacitor Cb1, the internal diode of the first falling switching device S14, the inductor L11, the second voltage switching device S12 to the ground terminal is formed, and thus, a driving voltage from a driving voltage source supplying the voltage Vcc is charged in the bootstrap capacitor Cb1 along the path.

The drive IC 831, the bootstrap capacitor Cb1, a bootstrap diode D10, and resistors R11, R12, and R13 form a switching device driving unit 830. The bootstrap diode D10 is connected so as to cut off a current path that can be formed between the driving voltage source supplying the voltage Vcc and the bootstrap capacitor Cb1 in a direction from the bootstrap capacitor Cb1 to the driving voltage source supplying the voltage Vcc.

The resistor R11 can be connected between the driving voltage source supplying the voltage Vcc and the bootstrap diode D10 in order to prevent an instant voltage change. Also, the resistors R12 and R13 can be respectively connected between the output terminal HO of the drive IC 831 and the gate terminal of the first falling switching device S14, and between the output terminal HO of the drive IC 831 and the gate terminal of the second falling switching device S15, in order to prevent an instant voltage change.

Figure 11:
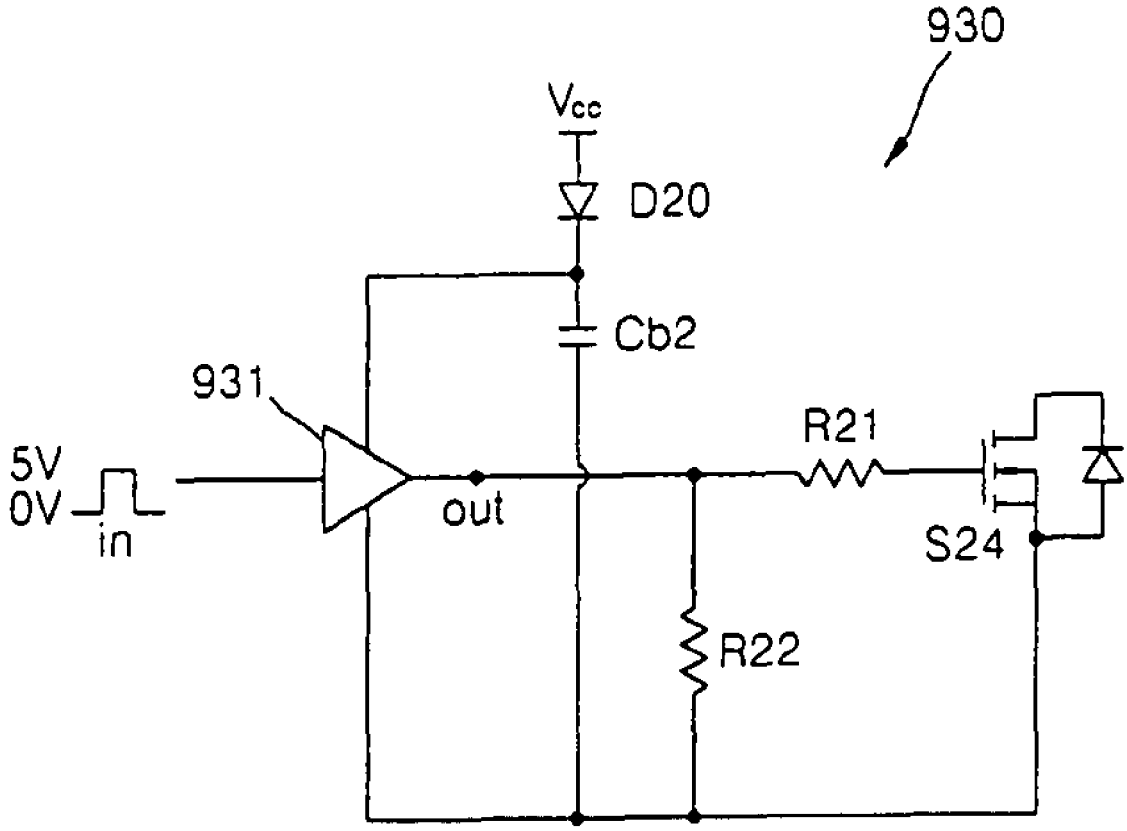
FIG. 11 is a diagram illustrating a switching device driving unit which drives a falling switching device illustrated in FIG. 10.

An amplifier 931, such as a push-pull amplifier, illustrated in FIG. 11, can be included in the drive IC 831, to receive a drive control signal and to amplify the drive control signal up to a voltage level that can operate the first and second falling switching devices S14 and S15 in order to output the amplified voltage.

Next, when the driving voltage is charged and a predetermined signal is inputted to an input terminal HIN, a switching control signal is outputted from an output terminal HO of the drive IC 831. The switching control signal is the common switching control signal, which drives the first and second falling switching devices S14 and S15.

Comparing this aspect of the present invention with that of FIG. 6, a waveform of the switching control signal is not distorted since a DC coupling capacitor Cd is not disposed between the drive IC 831 and the gate terminals of the first and second falling switching device S14 and S15. Also, the driving voltage can be stably charged, and the first and second falling switching devices S14 and S15 operate stably. Accordingly, reliability can be increased or achieved.

Figure 10:
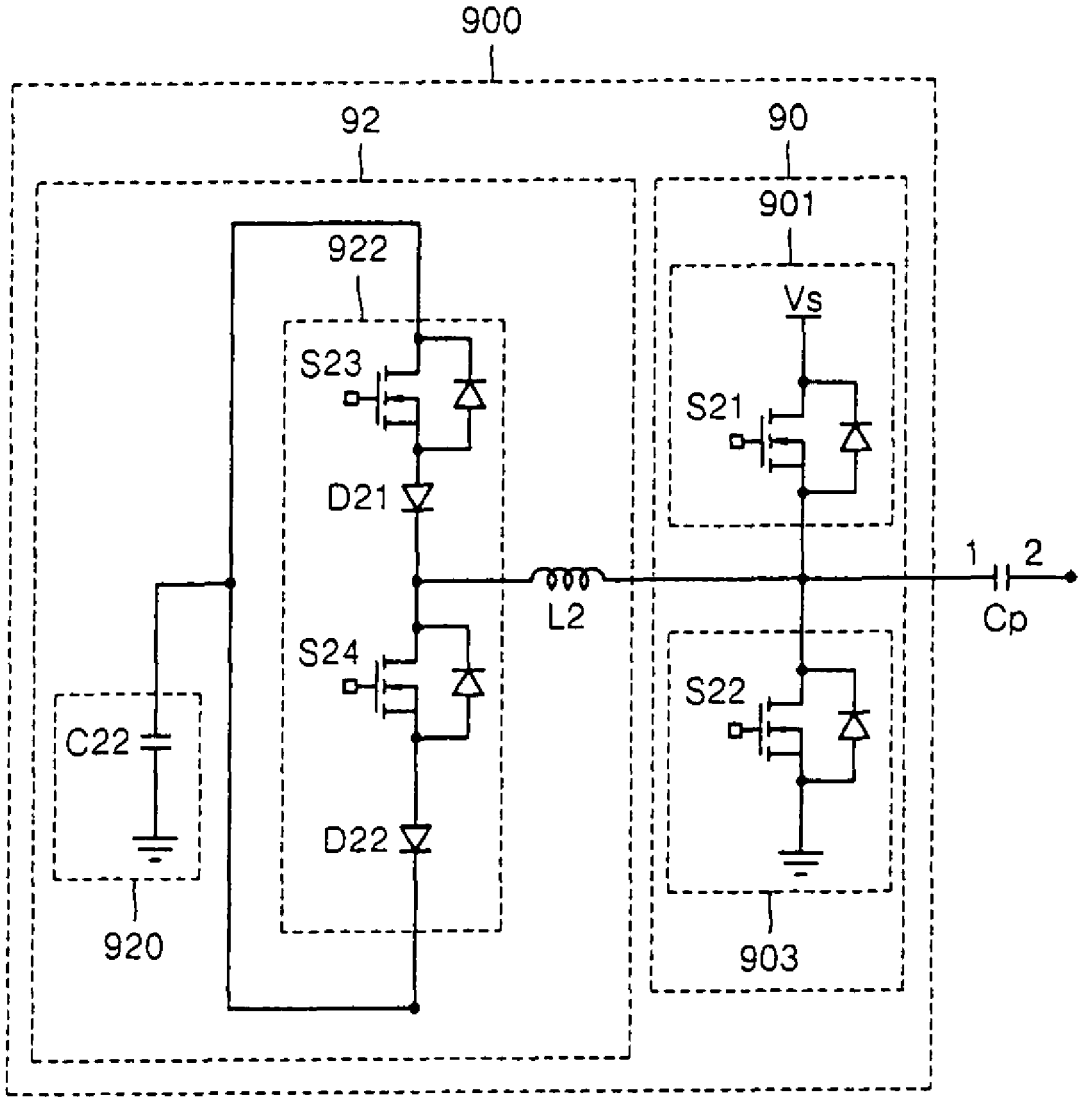
FIG. 10 is a circuit diagram illustrating a driving apparatus of a PDP according to another aspect of the present invention.

FIG. 10 is a circuit diagram illustrating a driving apparatus 900 of a PDP according to another aspect of the present invention. FIG. 11 is a diagram illustrating a switching device driving unit 930, which drives a falling switching device S24 illustrated in FIG. 10.

Referring to FIG. 10, the driving apparatus 900 of a PDP according to this aspect of the present invention includes a pulse application unit 90 and an energy recovery unit 92.

Hereinafter, the PDP will be considered to be electrically equivalent to a panel capacitor Cp.

The pulse application unit 90 applies pulses to the PDP, and includes a first voltage applying unit 901 and a second voltage applying unit 903. The first voltage applying unit 901 includes a first voltage source and a first voltage switching device S21 which switches a first voltage Vs supplied from the first voltage source and transmits the first voltage Vs to one end of the panel capacitor Cp (a first terminal). The second voltage applying unit 903 includes a second voltage source and a second voltage switching device S22 which switches a second voltage Vg from the second voltage source and transmits (connects or applies) the second voltage Vg to one end of the panel capacitor Cp (the first terminal). Here, the second voltage Vg may be a ground voltage.

The pulses (or applied pulses) may be sustain pulses applied alternatively to scan electrodes Y1 through Yn and sustain electrodes X1 through Xn during the sustain period PS as illustrated in FIG. 2. In this case, the first voltage Vs is a sustain voltage Vs. When the first voltage Vs is the sustain voltage Vs, one end of the panel capacitor Cp (the first terminal) may be a scan electrode, and the other end of the panel capacitor Cp (the second terminal) may be a sustain electrode. That is, the driving apparatus 900 according to this aspect of the present invention may be the Y driving unit 304 illustrated in FIG. 3.

Of course, when one end of the panel capacitor Cp (the first terminal) is the sustain electrode, the driving apparatus 900 may be the X driving unit 308 illustrated in FIG. 3. Also, the pulses may be the address pulses applied to the address electrodes A1 through Am during the address period PA as illustrated in FIG. 2. Accordingly, one or more of the electrodes may be connected to the driving apparatus 900.

The energy recovery unit 92 includes an inductor L2, an energy recovery determiner 922, and an energy storage unit 920. The energy recovery unit 92 recovers and accumulates charges (energy) in the panel capacitor Cp or emits the accumulated (or stored) charges (energy) to the panel capacitor Cp. The inductor L2 generates an LC resonance with a capacitive element of the panel capacitor Cp in order to transmit energy while the pulses increase and decrease.

Here, the inductor L2 may be connected between the energy recovery determiner 922 and the panel capacitor Cp, or between the energy recovery determiner 922 and the pulse application unit 90.

The energy recovery determiner 922 includes a falling switching device S24, a falling diode D22, a rising switching device S23, and a diode D21 which is a one-way conduction device. The falling switching device S24 and the falling diode D22 are disposed on a path along which charges (energy) from the panel capacitor Cp are transmitted to the energy storage unit 920. The rising switching device S23 and the diode D21 are disposed on a path along which charges (energy) from the energy storage unit 220 are transmitted to the panel capacitor Cp.

The energy storage unit 920 can be embodied (or include) as an energy storage capacitor C22, and the energy storage capacitor C22 is disposed between the energy recovery determiner 920 and a ground terminal.

Hereinafter, operations of the driving apparatus 900 according to this aspect of the present invention will be described with reference to the waveform of the sustain pulses as illustrated in FIG. 5. During the first period Ta, the rising switching device S23 is turned on, and thus, charges (energy) stored in the energy storage unit 920 are transmitted to the panel capacitor Cp through a path formed by the rising switching device S23, the diode D21, and the inductor L2. At this time, an LC resonance is generated by the inductor L2 and the capacitive element of the panel capacitor Cp.

During the second period Tb, the first voltage switching device S21 is turned on, and thus, the first voltage Vs is transmitted from the first voltage source to the panel capacitor Cp. During the third period Tc, the falling switching device S24 and the falling diode D22 are turned on, and thus, charges (energy) of the panel capacitor Cp are transmitted to the energy storage unit 920 through the inductor L2, the falling switching device S24, and the falling diode D22. During the fourth period Td, the second voltage switching device S22 is turned on, and thus, the second voltage Vg is transmitted to the panel capacitor Cp.

The falling switching device S24 can be embodied as (or include) a FET. Also, a switching control signal is inputted to a gate terminal of the falling switching device S24. The falling diode D22 functions as a one-way conduction device similar to the falling diode D2 illustrated in FIG. 6. That is, during the first period Ta, the charges (energy) from the energy storage unit 920 cannot be transmitted therethrough since the falling switching device S24 is turned off.

Hereinafter, operations of the falling switching device S24 and the falling diode D22 will be described in detail with reference to FIGS. 10 and 11. The falling switching device S24 is driven by a switching device driving unit 930, and is electrically connected to a drive IC 931. In order for the falling switching device S24 to operate, a bootstrap capacitor Cb2 connected to a source terminal is first charged. When the second voltage switching device S22 is turned on, a driving voltage from a driving voltage source supplying the voltage Vcc is charged in the bootstrap capacitor Cb2 along a path formed from the bootstrap capacitor Cb2, the internal diode of the falling switching device S24, the inductor L2, and the second voltage switching device S22 to the ground terminal.

Here, the drive IC 931, the bootstrap capacitor Cb2, a bootstrap diode D20, and resistors R21 and R22 form the switching device driving unit 930.

The drive IC 931 may be an amplifier 931 which receives and amplifies a drive control signal up to a voltage level that can operate the falling switching device S24 in order to output the amplified voltage.

The amplifier 931 outputs a high level voltage or a low level voltage, which can drive the gate terminal of the falling switching device S24 in response to a control signal (in). The control signal (in) is a signal to control the turning on/off of the falling switching device S24, outputted from the logic controller 302 illustrated in FIG. 3. The control signal (in) has a low voltage range used in the logic controller 302. However, the turning on/off of the falling switching device S24 cannot be controlled by only using the levels of the control signal (in). Accordingly, the amplifier 931 is used in order to amplify the levels of the control signal (in). The amplifier 931 may be a push-pull amplifier.

A high level power input terminal of the amplifier 931 is connected to one end of the bootstrap capacitor Cb2, and another end of the bootstrap capacitor Cb2 and a low level power input terminal of the amplifier 931 are each connected to a source terminal of the falling switching device S24. Also, the one end of the bootstrap capacitor Cb2 is connected, for example, to a power source supplying the voltage Vcc of 15V. An output terminal of the amplifier 931 is connected to the gate terminal of the falling switching device S24 through the resistor R21.

When the second voltage switching device S22 is turned on and 0V is being applied to the one end of the panel capacitor Cp, a drain voltage of the falling switching device S24, which is a voltage caught in one end of the inductor L2, is also 0V, since the diode D20 is not disposed between the inductor L2 and the falling switching device S24 as shown in FIGS. 10 and 11, and unlike the decreasing diode 2 as shown in FIGS. 6 and 7. Accordingly, a source voltage of the falling switching device S24 becomes the drain voltage 0V of the falling switching device S24, due to a body diode of the falling switching device S24. Thus, the bootstrap capacitor Cb2 is charged to a voltage of 15V.

Here, a diode D20 may be additionally disposed between the driving voltage source supplying the voltage Vcc and the bootstrap capacitor Cb2 in order to cut off a current path that could be formed in a direction from the bootstrap capacitor Cb2 to the driving voltage source supplying the voltage Vcc.

Hereinafter, operations of the switching device driving unit 930 illustrated in FIG. 11 will be described.

First, when the control signal (in) becomes 5V in order to reduce a voltage of the panel capacitor Cp during the third period Tc of FIG. 5, the amplifier 931 outputs a voltage of one terminal, which is a high level power input terminal, of the bootstrap capacitor Cb2. Since the bootstrap capacitor Cb2 is bootstrapped, the voltage of the high level power input terminal of the bootstrap capacitor Cb2 is 15V higher than a source voltage of the falling switching device S24, which is a voltage of another terminal of the bootstrap capacitor Cb2.

That is, an output voltage out of the amplifier 931 is 15V higher than the source voltage of the falling switching device S24. Accordingly, a gate-source voltage of the falling switching device S24 becomes 15V, and thus, the falling switching device S24 is turned on.

When the control signal (in) becomes 0V during the fourth, first, and second periods Td, Ta, and Tb, after the voltage of the panel capacitor Cp decreases, the amplifier 931 outputs the source voltage of the falling switching device S24, which is the low level power input terminal. Then, a gate-source voltage of the falling switching device S24 becomes 0V, and thus, the falling switching device S24 is turned off.

Accordingly, both ends of the bootstrap capacitor C2 always have a voltage of 15V, and thus, the bootstrap capacitor Cb2 having a low internal pressure (or voltage) can be used. Since the output voltage of the amplifier 931 is directly transmitted to the gate terminal of the falling switching device S24 without passing through the bootstrap capacitor Cb2, the waveform is not distorted. Also, since the drain terminal of the falling switching device S24 is directly connected to the inductor L2 or an electrode of the PDP without going through the diode D22, the bootstrap capacitor Cb2 can be charged to a voltage of 15V.

In the aspect of the present invention 15V is outputted from the amplifier 931, but another voltage having a different level, which can stably turn on the falling switching device S24 can be used.

Also in the aspects of the present invention, the sustain pulses having the first voltage Vs are applied alternatively to the scan electrodes Y1 through Yn and the sustain electrodes X1 through Xn, as described in FIG. 4. However, unlike FIG. 4, sustain pulses, in which the voltage differences of the scan electrodes Y1 through Yn and the sustain electrodes X1 through Xn are alternatively the first voltage Vs and a negative first voltage −Vs, can be applied to the scan electrodes Y1 through Yn and/or the sustain electrodes X1 through Xn. For example, while the scan electrodes Y1 through Yn are biased to the ground voltage, the sustain pulses alternatively having the first voltage Vs and the negative first voltage −Vs can be applied to the sustain electrodes X1 through Xn. In this case, voltage levels of the power source connected to the energy storage capacitor C22 and the first and second voltage switching devices S21 and S22 can be changed.

In this aspect of the present invention, the energy recovery circuit is used during the sustain period PS, but the energy recovery circuit can also be used during the address period PA. That is, the address pulses applied to the address electrodes A1 through Am during the address period PA can be generated using the energy recovery circuit.

Also, comparing this aspect of the present invention with the aspect illustrated in FIG. 6, since the DC coupling capacitor Cd is not disposed between the amplifier 931 and the gate terminal of the falling switching device S24, the waveform is not distorted. Also, the driving voltage can be stably charged and the falling switching device S24 operates stably. Accordingly, reliability can be increased or achieved.

Figure 12:
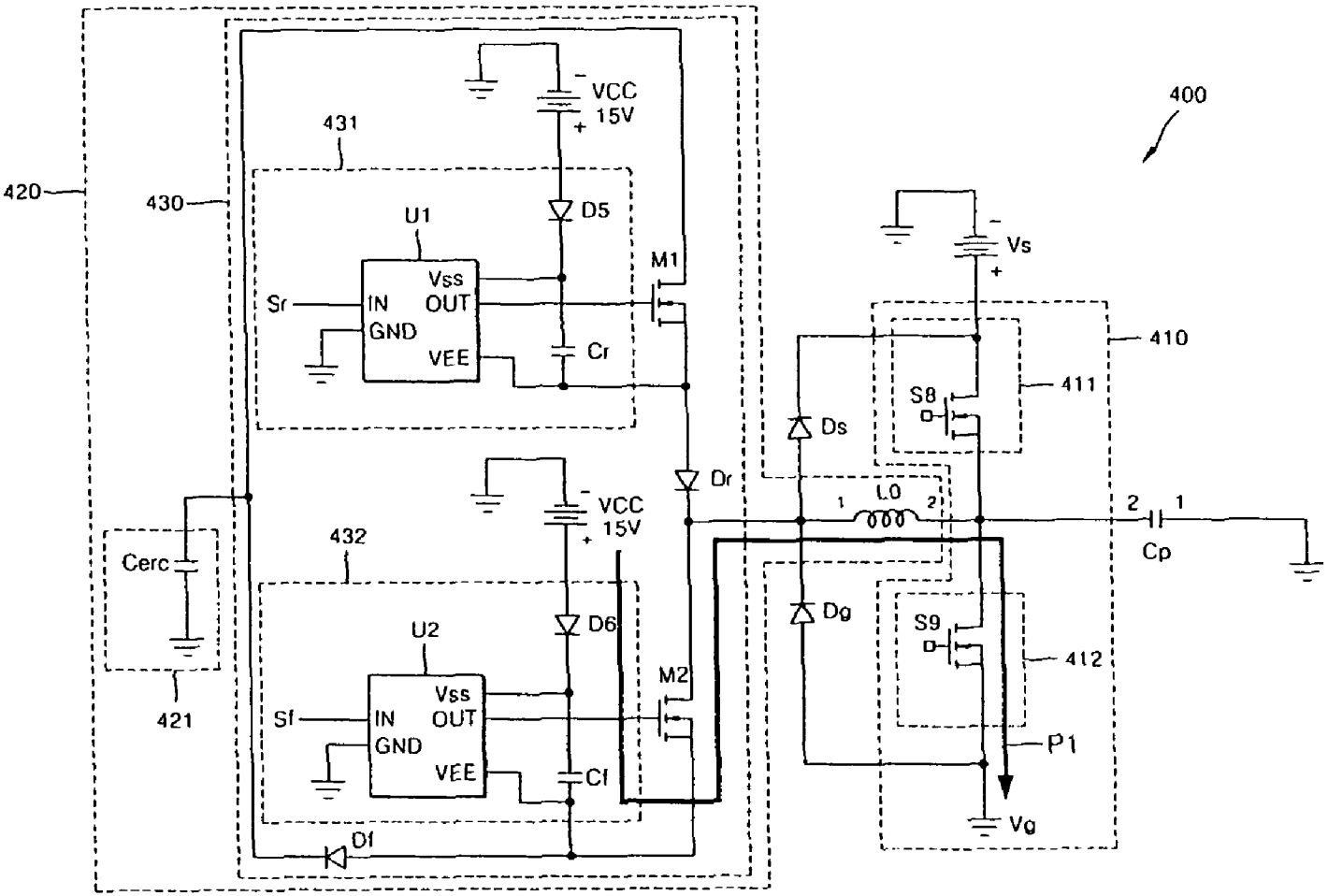
FIG. 12 is a circuit diagram illustrating an energy recovery circuit and a driving apparatus of a PDP according to another aspect of the present invention.

FIG. 12 is a circuit diagram illustrating an energy recovery circuit 420 and a driving apparatus 400 of a PDP according to another aspect of the present invention.

Referring to FIG. 12, the driving apparatus 400 drives the PDP 1 illustrated in FIG. 1 having a panel capacitor Cp between at least two electrode lines from among the plurality of electrode lines. The driving apparatus 400 includes a pulse application unit 410 and an energy recovery circuit 420. The energy recovery units 82 and 92 illustrated in FIGS. 8 and 10 correspond to the energy recovery circuit 420 of the aspects of the present invention.

The pulse application unit 410 supplies a discharge voltage to the electrode lines. The panel capacitor Cp generates discharges by using the discharge voltage. The energy recovery circuit 420 recovers energy from the panel capacitor Cp or charges energy in (or to) the panel capacitor Cp.

The electrode lines forming the panel capacitor Cp may be sustain electrode lines. That is, the panel capacitor Cp may be formed between the sustain electrode X1 through Xn lines and/or the scan electrode Y1 through Yn lines illustrated in FIG. 1. Also, the pulse application unit 410 may be a sustain pulse application unit inside the X driving unit 308 illustrated in FIG. 3, or a sustain pulse application unit inside the Y driving unit 304 illustrated in FIG. 3.

One end of the pulse application unit 410 is connected to a first voltage supply terminal which supplies a first voltage Vs, and another end is connected to a second voltage supply terminal which supplies a second voltage Vg. The sustain pulses as illustrated in FIG. 5 are applied to the sustain electrodes X1 through Xn lines and the scan electrodes Y1 through Yn lines during the sustain period PS as illustrated in FIG. 4 by the pulse application unit 410.

Alternatively, voltages having a first level Vs and a second level Vg, in which the magnitude are the same but the polarities are opposite, can be alternatively applied to the sustain electrodes X1 through Xn lines and the scan electrodes Y1 through Yn lines during the sustain period PS as illustrated in FIG. 4.

The pulse application unit 410 includes a first voltage applying unit 411 and a ground (or a second) voltage applying unit 412. The first voltage applying unit 411 outputs a first voltage Vs to one end of the electrode lines (a first terminal of the panel capacitor Cp) in order to output a drive signal to the one end of the electrode lines (the first terminal of the panel capacitor Cp). The ground (or the second) voltage applying unit 412 outputs a ground (or the second) voltage Vg to the one end of the electrode lines (the first terminal of the panel capacitor Cp).

Alternatively, the panel capacitor Cp may be formed between the address electrodes A1 through Am lines and the scan electrodes Y1 through Yn lines illustrated in FIG. 1. In various aspects, the pulse application unit 410 may be a data (or address) pulse application unit, which applies data (or address) pulses to the address driving unit 306 as illustrated in FIG. 3.

The energy recovery circuit 420 recovers energy from the panel capacitor Cp or charges energy in (or to) the panel capacitor Cp. When the discharge voltage is applied to each of the electrode lines by the pulse application unit 410 (sustain period PS as illustrated in FIG. 4), the energy recovery circuit 420 first supplies stored energy. Accordingly, a voltage applied to the electrode lines by the stored energy can increase from the level of the ground voltage Vg as illustrated in FIG. 4 to the level of the discharge voltage (the first voltage Vs as illustrated in FIG. 4) or at least a level nearest to the level of the discharge voltage.

That is, the voltage applied to the electrode lines is increased to the level of the discharge voltage or to a predetermined level near to the level of the discharge voltage, and then, the discharge voltage is applied to the electrode lines. Accordingly, the burden of switching is reduced and consumption of reactive power is reduced in order to efficiently use energy.

When the ground voltage is applied to each of the electrode lines by the pulse application unit 410 (sustain period PS as illustrated in FIG. 4), the energy charged in the panel capacitor Cp is stored in an energy storage unit 421, i.e. an energy recovery capacitor Cerc. Also, the energy charged in the panel capacitor Cp is recovered to the energy recovery capacitor Cerc in order to decrease the voltage applied to the electrode lines from the ground voltage (the first voltage Vs as illustrated in FIG. 4) to the ground voltage Vg as illustrated in FIG. 4 or at least nearest (or close) to the ground voltage Vg as illustrated in FIG. 4.

That is, the voltage applied to the electrode lines are increased to the discharge voltage or to a predetermined level near to the discharge voltage, and then, the ground voltage Vg is applied to the electrode lines. Accordingly, the burden of switching is reduced and consumption of reactive power is reduced in order to efficiently use energy.

The energy recovery circuit 420 includes the energy storage unit 421, an energy recovery determiner 430, and an inductor L0, though not required.

The energy storage unit 421 is charged by recovering energy from the panel capacitor Cp. A charging voltage of the energy storage unit 421 may be a voltage corresponding to ½ of a power voltage (the first voltage Vs as illustrated in FIG. 4) supplied by the pulse application unit 410 for discharges in the panel capacitor Cp.

One end of the inductor L0 is connected to one end of the energy recovery determiner 430, and the other end of the inductor L0 is connected to the panel capacitor Cp. The inductor L0 generates a resonance with the panel capacitor Cp when the panel capacitor Cp is charged/discharged.

The other end of the energy recovery determiner 430 is connected to the energy storage unit 421, which enables the energy recovery determiner 430 to control charging and recovering of energy from the energy storage unit 421 to the panel capacitor Cp. The energy recovery determiner 430 includes a rising switching device M1, a falling switching device M2, a rising diode Dr, and a falling diode Df.

The rising switching device M1 and the falling switching device M2 are connected in parallel between the energy storage unit 421 and the inductor L0. The rising diode Dr is connected between the rising switching device M1 and the inductor L0, so that a current can flow from the rising switching device M1 to the inductor L0. The falling diode Df is connected between the falling switching device M2 and the energy storage unit 421, so that a current can flow from the falling switching device M2 to the energy storage unit 421.

In the energy recovery determiner 430, a current generated due to the energy stored in the energy storage unit 421 is controlled to flow from the energy storage unit 421 to the panel capacitor Cp, by way of the rising switching device M1 and the rising diode Dr. Also, in the energy recovery determiner 430, a current generated due to the discharge voltage charged in the panel capacitor Cp is controlled to flow from the panel capacitor Cp to the energy storage unit 421, by way of the falling switching device M2 and the falling diode Df.

In a non-limiting aspect, the rising switching device M1 may be a FET, in which a first terminal is a drain terminal, a second terminal is a source terminal, and a third terminal is a gate terminal. The first terminal is connected to the energy storage unit 421. The second terminal is connected to the rising diode Dr. A current flowing from the first terminal to the second terminal is controlled by a signal applied to the third terminal.

The energy recovery determiner 430 includes a rising switching device driving unit 431 to drive the rising switching device M1. One terminal of the rising switching device driving unit 431 is connected to a first voltage source supplying a voltage VCC, and another terminal is connected between the rising switching device M1 and the rising diode Dr.

The rising switching device driving unit 431 includes a driving device U1 which controls the application of a signal from the first voltage source supplying a voltage VCC to the third terminal of the rising switching device M1, by using an input signal Sr that is input from the outside.

The driving device U1 includes a drive signal input terminal IN receiving the input signal Sr, a power applying terminal Vss connected to the first power voltage source VCC, and an output terminal OUT connected to the third terminal of the rising switching device M1. Here, the power applying terminal Vss is connected to the first voltage source VCC through a diode D5 in order for a current to flow from the first voltage source VCC to the power applying terminal Vss.

A terminal VEE of the driving device U1 is connected between the rising switching device M1 and the rising diode Dr, and the power applying terminal VCC and a capacitor Cr. Accordingly, the rising switching device M1 is turned on since a voltage (for example, 15V) applied by the first voltage source VCC is caught between the gate terminal (the third terminal) and the source terminal (the second terminal) of the first control switch M1 by the input signal Sr.

The falling switching device M2 may be a FET, wherein a first terminal is a drain terminal, a second terminal is a source terminal, and a third terminal is a gate terminal. The first terminal is connected to the panel capacitor Cp by means of the inductor L0. The second terminal is connected to the falling diode Df. A current flowing from the first terminal to the second terminal is controlled by a signal applied to the third terminal.

The energy recovery determiner 430 includes a falling switching device driving unit 432 to drive the falling switching device M2. One terminal of the falling switching device driving unit 432 is connected to a second voltage source VCC and the other terminal is connected between the falling switching device M2 and the falling diode Df.

The falling switching device driving unit 432 includes a driving device U2 which controls the application of a signal from the second voltage source VCC to the third terminal of the falling switching device M2, by using an input signal Sf that is input from the outside.

The driving device U2 includes a drive signal input terminal IN receiving the input signal Sf, a power applying terminal Vss connected to the second voltage source VCC, and an output OUT connected to the third terminal of the falling switching device M2. Here, the power applying terminal VCC is connected to the second voltage source VCC through a diode D6 which is connected in order for a current to flow from the second power source VCC to the power applying terminal VCC.

A terminal VEE of the driving device U2 is connected between the falling switching device M2 and the falling diode Df, and the power applying terminal VCC and a capacitor Cf. Accordingly, the falling switching device M2 is turned on since a voltage (for example, 15V) applied by the second voltage source VCC is caught between the gate terminal (the third terminal) and the source terminal (the second terminal) of the second control switch M2 by the input signal Sf.

Specifically in to this aspect, the falling diode Df is connected between the falling switching device M2 and the energy storage unit 421 in order for a current to flow from the falling switching device M2 to the energy storage unit 421.

In other words, when a switching device of the ground voltage applying unit 412 is turned on, a current resulting from the 15V applied by the second voltage source VCC relative to the ground is charged along a bootstrap charging path P1 and through the capacitor Cf, which is a bootstrap capacitor. That is, during an initial booting, the current resulting from the 15V applied by the second voltage source VCC is charged in the capacitor Cf, along the bootstrap charging path P1 from the second power source VCC, the diode D6, the capacitor Cf, the second control switch M2, the inductor L0, and to the switching device of the ground voltage applying unit 412.

Accordingly, similar to the rising switching device driving unit 431, and the falling switching device driving unit 432, the second control switch M2 is turned on since a voltage (for example, 15V) applied by the second voltage source VCC is caught between the gate terminal (the third terminal) and the source terminal (the second terminal) of the second control switch M2 by the input signal Sf.

The bootstrap capacitor Cf is charged by a floating voltage of 15V, such as the charging method in the rising switching device driving unit 431. Accordingly, an additional DC blocking capacitor is not required to drive the second control switch M2. Thus, the second control switch M2 can operate stably, and the reliability of the energy recovery circuit 420 can be increased. Also, by not using the DC blocking capacitor, production costs can decrease.

As described above, the present invention has following advantages, and other advantages.

According aspects of the present invention, the falling switching devices of the energy recovery unit are common source connected and the DC coupling capacitor is not used. Accordingly, driving voltages can be stably charged, falling switching devices can operate stably and the possibilities of heat emission and burnout are decreased. Thus, reliability of the driving apparatus can be achieved.

According to aspects of the present invention, an energy recovery circuit of a display, which may be a plasma display, includes an inductor connected to the display, an energy storage unit to recover energy from the display, and an energy recovery unit connected between the inductor and the energy storage unit, wherein the energy recovery unit has a first unidirectional path to supply energy from the energy storage unit to the display, and a second unidirectional path to recover energy from the display, and the first and second unidirectional paths have parallel elements in parallel arrangement, as shown in the figures and as discussed above.

Although a few aspects of the present invention have been shown and described, it would be appreciated by those skilled in the art that changes may be made in the aspects without departing from the principles and spirit of the invention, the scope of which is defined in the claims and their equivalents.

What is claimed is:

1. A driving apparatus to drive a PDP (plasma display panel), the driving apparatus comprising:

a pulse application unit which applies a pulse to the PDP; and an energy recovery unit which comprises an inductor which generates LC resonance with a panel capacitor element of the PDP, an energy recovery determiner which determines accumulation of energy during the LC resonance or emission of the accumulated energy to the PDP, and an energy storage unit which stores the accumulated energy, wherein the energy recovery determiner comprises a first falling switching device which determines the accumulation of the energy; and a second falling switching device which is connected between the first falling switching device and the energy storage unit, in order for the second falling switching device to form a current path through the first falling switching device to the energy storage unit; and a rising switching device which determines an emission of the accumulated energy stored in the energy storage unit to the PDP, wherein the rising switching device and the second falling switching device are directly connected at a node between them.

2. The driving apparatus of claim 1, further comprising an internal diode connected to the second falling switching device to form a current path toward the energy storage unit.

3. The driving apparatus of claim 1, wherein the first falling switching device and the second falling switching devices are FETs (field effect transistors), and source terminals thereof are commonly connected.

4. The driving apparatus of claim 3, wherein a common switching control signal is inputted to gate terminals of the first falling switching device and the second falling switching device.

5. The driving apparatus of claim 3, further comprising a bootstrap capacitor connected to the common source terminal, and the bootstrap capacitor is charged, along a path of an internal diode of the first falling switching device, the inductor, and a ground terminal of the pulse application unit.

6. The driving apparatus of claim 1, wherein the energy recovery determiner further comprises a diode which is a one-way conduction device that transmits the accumulated energy to the PDP.

7. The driving apparatus of claim 1, wherein the pulse application unit comprises:

a first voltage source which supplies a first voltage;

a first voltage switching device which selectively transmits the first voltage to the PDP;

a second voltage source which supplies a second voltage; and a second voltage switching device which selectively transmits the second voltage to the PDP.

8. The driving apparatus of claim 7, wherein the second voltage is a ground voltage.

9. The driving apparatus of claim 1, wherein the energy storage unit comprises an energy storage capacitor which is connected between a ground terminal and the energy recovery determiner.

10. The driving apparatus of claim 1, wherein the pulse is a sustain pulse which is used to generate a sustain discharge in a discharge cell selected from among a plurality of discharge cells included in the PDP.

11. The driving apparatus of claim 1, wherein the pulse is an address pulse which is used to select a discharge cell that is to be turned on from among a plurality of discharge cells included in the PDP.

12. A driving apparatus to drive a PDP (plasma display panel), the driving apparatus comprising:

a pulse application unit which applies a pulse to the PDP;

an energy recovery unit which comprises an inductor which generates an LC resonance with a panel capacitor element of the PDP, an energy recovery determiner which determines accumulation of energy during the LC resonance or emission of the accumulated energy to the PDP, and an energy storage unit which stores the accumulated energy, wherein the energy recovery determiner comprises a falling switching device directly connected to the inductor, the falling switching device being configured to determine the accumulation of the energy, and a falling diode which is a one-way conduction device that is connected between the falling switching device and the energy storage unit in order to form a current path in a direction from the falling switching device to the energy storage unit; and a switching device driving unit which is electrically connected to a driving terminal of the falling switching device so as to apply a high level voltage or a low level voltage in order to drive the falling switching device, wherein the switching device driving unit comprises a push-pull amplifier which outputs a high level voltage or a low level voltage in response to a single-ended logic input signal that controls operations of the falling switching device.

13. The driving apparatus of claim 12, further comprising:

a bootstrap capacitor connected between a power supply terminal of the high level voltage and a power supply terminal of the low level voltage.

14. The driving apparatus of claim 12, wherein the falling switching device is a FET, and a source terminal of the FET is connected to the falling diode.

15. The driving apparatus of claim 13, wherein the bootstrap capacitor is charged along a path of an internal diode of the falling switching device, the inductor, and a ground terminal of the pulse application unit.

16. The driving apparatus of claim 13, wherein one end of the bootstrap capacitor is electrically connected to a high level power input terminal of the push-pull amplifier, and another end of the bootstrap capacitor is electrically connected to a low level power input terminal of the push-pull amplifier and a source terminal of the falling switching device.

17. The driving apparatus of claim 16, wherein the switching device driving unit further comprises a bootstrap diode which is electrically connected between a driving voltage source and the one end of the bootstrap capacitor.

18. The driving apparatus of claim 12, wherein the switching device driving unit further comprises:

a first resistor which is electrically connected between an output terminal of the push-pull amplifier and a gate terminal of the falling switching device; and a second resistor which is electrically connected between the output terminal of the push-pull amplifier and a source terminal of the falling switching device.

19. The driving apparatus of claim 12, wherein the low level voltage is a ground voltage.

20. The driving apparatus of claim 12, wherein the energy recovery determiner further comprises:

a rising switching device which determines the emission of the accumulated energy stored in the energy storage unit to the PDP; and a rising diode which is a one-way conduction device that transmits the accumulated energy to the PDP.

21. The driving apparatus of claim 12, wherein the pulse application unit comprises:

a first voltage source which supplies a first voltage;

a first voltage switching device which switches the first voltage and transmits the first voltage to the PDP;

a second voltage source which supplies a second voltage; and a second voltage switching device which switches the second voltage and transmits the second voltage to the PDP.

22. The driving apparatus of claim 21, wherein the second voltage is a ground voltage.

23. The driving apparatus of claim 12, wherein the energy storage unit comprises an energy storage capacitor which is connected between a ground terminal and the energy recovery determiner.

24. The driving apparatus of claim 12, wherein the pulse is a sustain pulse which is used to generate a sustain discharge in a discharge cell selected from among a plurality of discharge cells included in the PDP.

25. The driving apparatus of claim 12, wherein the pulse is an address pulse which is used to select a discharge cell to be turned on from among a plurality of discharge cells included in the PDP.

26. An energy recovery circuit in a display panel having a panel capacitor between at least two electrode lines from among a plurality of electrode lines, wherein the energy recovery circuit recovers power from the panel capacitor or charges power to the panel capacitor, the energy recovery circuit comprising:

an energy storage unit which is charged by recovering power from the panel capacitor;

an energy recovery determiner which controls charging or recovery of power from the energy storage unit to the panel capacitor;

an inductor in which one end is connected to an end of the energy recovery determiner, and another end is connected to the panel capacitor, wherein the energy recovery determiner comprises:

a rising switching device and a falling switching device which are connected in parallel between the energy storage unit and the inductor, wherein the falling switching device is directly connected to the inductor, a rising diode which is connected between the rising switching device and the inductor in order for a current to flow from the rising switching device to the inductor, and a falling diode which is connected between the falling switching device and the energy storage unit in order for a current to flow from the falling switching device to the energy storage unit; and a rising switching device driving unit to drive the rising switching device and a falling switching device driving unit to drive the falling switching device, wherein each switching device driving unit further comprises a push-pull amplifier which outputs a high level voltage or a low level voltage in response to a single-ended logic input signal that controls operations of the rising switching device and falling switching device.

27. The energy recovery circuit of claim 26, wherein one terminal of the rising switching device driving unit is connected to a first voltage source, and another terminal of the rising switching device driving unit is connected between the rising switching device and the rising diode.

28. The energy recovery circuit of claim 27, wherein the rising switching device comprises a first terminal connected to the energy storage unit, a second terminal connected to the rising diode, and a third terminal, wherein current flow from the first terminal to the second terminal is controlled by a signal applied to the third terminal.

29. The energy recovery circuit of claim 28, wherein the rising switching device is an FET, wherein the first terminal is a drain terminal, the second terminal is a source terminal, and the third terminal is a gate terminal.

30. The energy recovery circuit of claim 28, wherein the rising switching device driving unit comprises a driving device which controls application of a signal from the first voltage source to a third terminal of a first control switch, by the single-ended logic input signal.

31. The energy recovery circuit of claim 30, wherein the driving device comprises a drive signal input terminal wherein the single-ended logic input signal is applied, a power applying terminal which is connected to the first voltage source, and an output terminal which is connected to the third terminal of the first control switch.

32. The energy recovery circuit of claim 31, wherein the power applying terminal is connected between the rising switching device and the rising diode through a first capacitor.

33. The energy recovery circuit of claim 26, wherein one terminal of the falling switching device driving unit is connected to a second voltage source, and another terminal of the falling switching device driving unit is connected between the falling switching device and the falling diode.

34. The energy recovery circuit of claim 33, wherein the falling switching device comprises a first terminal connected to the inductor, a second terminal connected to the falling diode, and a third terminal, wherein current flow from the first terminal to the second terminal is controlled by a signal applied to the third terminal.

35. The energy recovery circuit of claim 34, wherein the falling switching device is an FET, wherein the first terminal is a drain terminal, the second terminal is a source terminal, and the third terminal is a gate terminal.

36. The energy recovery circuit of claim 34, wherein the falling switching device driving unit comprises a driving device which controls application of a signal from the second voltage source to a third terminal of a second control switch, by the single-ended logic input signal.

37. The energy recovery circuit of claim 36, wherein the driving device comprises a drive signal input terminal in which the single-ended logic input signal is applied, a power applying terminal connected to the second voltage source, and an output terminal connected to the third terminal of the second control switch.

38. The energy recovery circuit of claim 37, wherein the power applying terminal is connected between the falling switching device and the falling diode through a second capacitor.

39. The energy recovery circuit of claim 26, wherein the energy storage unit comprises a capacitor which charges an electric charge by recovering the electric charge from the panel capacitor and charges the panel capacitor using the charged electric charge.

40. The energy recovery circuit of claim 26, wherein the inductor generates resonance with the panel capacitor during a charging/discharging operation of the panel capacitor.

41. An energy recovery circuit of a display, comprising:

an inductor connected to the display;

an energy storage unit to recover energy from the display; and an energy recovery determiner connected between the inductor and the energy storage unit, wherein the energy recovery determiner has a first unidirectional path to supply energy from the energy storage unit to the display, and a second unidirectional path to recover energy from the display, and the first and second unidirectional paths have parallel elements in parallel arrangement, wherein the energy recovery determiner includes a rising switching device and a rising diode, and a first falling switching device and a second falling switching device, and wherein the rising diode is arranged after the rising switching device in the first unidirectional path, and the second falling switching device is arranged after the first falling switching device in the second unidirectional path, wherein the rising switching device and the second falling switching device are directly connected at a node between them.

42. The energy recovery circuit of claim 41, wherein the first and the second falling switching devices are field effect transistors having a source, a drain, and a gate, and the circuit further comprises:

a drive to drive the first and second falling switching devices; and a driving source to provide a driving source voltage, wherein an output of the drive is connected to both the gate of the first falling switching device and the gate of the second falling switching device, and the driving source is connected to both the source of the first falling switching device and the source of the second falling switching device.

43. The energy recovery circuit of claim 41, wherein the first and second falling switching devices are common source connected.

44. The energy recovery circuit of claim 43, further comprising a drive circuit to drive the first and second falling switching devices, wherein the drive circuit lacks a DC coupling capacitor.

* * * * *

UNITED STATES PATENT AND TRADEMARK OFFICE

CERTIFICATE OF CORRECTION

PATENT NO. : 8,106,855 B2
APPLICATION NO. : 11/711082
DATED : January 31, 2012
INVENTOR(S) : Hak-ki Choi et al.

It is certified that error appears in the above-identified patent and that said Letters Patent is hereby corrected as shown below:

In the Claims

Column 18, Claim 3, line 36. Delete "devices"

Insert -- device --

Signed and Sealed this
Sixteenth Day of October, 2012

David J. Kappos

David J. Kappos
*Director of the United States Patent and Trademark Office*